US005829869A

United States Patent [19]

Clegg et al.

[11] Patent Number: 5,829,869

[45] Date of Patent: Nov. 3, 1998

[54] ELECTRIC CANDLE LIGHT SYSTEM

[76] Inventors: Thomas J. Clegg, 1743 Millwood La., Montoursville, Pa. 17754; Mark Maclean-Blevins, 679 Arbor Dr., Westminster, Md. 21158

[21] Appl. No.: 787,053

[22] Filed: Jan. 28, 1997

[51] Int. Cl.[6] ..... F21P 1/02; F21V 21/00; F21V 21/14

[52] U.S. Cl. ..... 362/392; 362/391; 362/393; 362/414

[58] Field of Search ..... 362/391, 392, 362/183, 414, 393

[56] References Cited

U.S. PATENT DOCUMENTS

| | | | |
|---|---|---|---|
| 2,009,965 | 7/1935 | Pollock | 362/392 |
| 2,884,555 | 4/1959 | Peterson . | |
| 4,217,018 | 8/1980 | Yoshida et al. . | |
| 4,449,168 | 5/1984 | Ewing . | |
| 4,606,595 | 8/1986 | Dola . | |
| 4,763,232 | 8/1988 | Woodside . | |
| 4,839,780 | 6/1989 | Chuan et al. | 362/392 |
| 4,984,999 | 1/1991 | Leake . | |
| 5,109,324 | 4/1992 | Ahroni . | |
| 5,124,903 | 6/1992 | Coviello | 362/392 |
| 5,141,449 | 8/1992 | Tieszen . | |
| 5,152,602 | 10/1992 | Boschetto | 362/392 |
| 5,161,881 | 11/1992 | Myson . | |
| 5,199,781 | 4/1993 | Sweeny . | |
| 5,280,417 | 1/1994 | Hall et al. | 362/391 |
| 5,321,592 | 6/1994 | Marinacci | 362/391 |
| 5,328,385 | 7/1994 | Cheu . | |
| 5,329,437 | 7/1994 | Briggs . | |
| 5,398,180 | 3/1995 | Lee | 362/391 |
| 5,432,689 | 7/1995 | Sharrah et al. . | |
| 5,446,640 | 8/1995 | Lin . | |
| 5,474,467 | 12/1995 | Chen . | |
| 5,552,348 | 9/1996 | Wu . | |
| 5,556,298 | 9/1996 | Huang . | |
| 5,601,360 | 2/1997 | Paquette | 362/183 |
| 5,658,073 | 8/1997 | Lee | 362/414 |
| 5,664,879 | 9/1997 | Lai | 362/392 |

*Primary Examiner*—Sandra L. O'Shea
*Assistant Examiner*—Matthew J. Spark
*Attorney, Agent, or Firm*—Rosenberg, Klein & Bilker

[57] ABSTRACT

An electric candle light system is provided wherein one or more lamp holders (20) are releasably coupled to a building structure (12) by respective number of bracket members (70). Each bracket member (70) includes a wireway (80) through which a power cord (100) is passed. Each lamp holder (20) includes an open channel (44) into which the respective bracket member (70) is received. A pair of insulation piercing terminals (50) disposed within the open channel (44) make an electrical connection between the lamp leads (26, 28) and the respective insulated conductors (104, 106) of the power cord (100).

17 Claims, 6 Drawing Sheets

ELECTRIC CANDLE LIGHT SYSTEM

BACKGROUND OF THE INVENTION

1. Field of the Invention

This invention directs itself to decorative electric lighting window displays. In particular, this invention directs itself to a modular lighting system wherein an electric candle is releasably coupled to a building structure. Still further, this invention directs itself to a building mounted bracket structure having a wireway formed therein. A plurality of such brackets may be mounted to the building and a two conductor power cord threaded through the wireway of each bracket. More in particular, this invention pertains to an electric candle stick secured to a base, wherein the base is releasably coupled to the building mounted bracket. Further, the base supports a pair of insulation piercing terminals which are electrically coupled to the conductors of the power cord when the base is lockingly engaged with the bracket.

2. Prior Art

Electric candles are used for their aesthetic appeal and are reminiscent of old-fashioned wax candles set on window sills for decoration. Most commonly, such electric candles are utilized to decorate a building structure during the winter holiday season.

It is most common to find such prior art electric candles placed in windows inside the home for viewing from the outside of the home, either just sitting on the window sill, taped down, or otherwise held in position by a strap or other holding device. However, each electric candle stick is an individual lamp having its own power cord which must also be taped down or otherwise kept out of the way and individually connected to an electrical outlet. Such prior art electric candles present a hazard, as they are prone to being inadvertently displace from the window sill. Additionally, these prior art electric candles are unusable in some newer homes, as many new style homes are built without any window sills.

Electric candle sticks and lighting systems where a socket may be connected to a power cord through insulation piercing terminals are known in the art. The best prior art known to the Applicant include U.S. Pat. Nos. 5,556,298; 4,217,018; 4,606,595; 4,763,232; 5,432,689; 5,446,640; 2,884,555; 5,328,385; 5,161,881; 5,199,781; 5,329,437; 4,449,168; 5,141,449; 5,474,467; 4,984,999; 5,552,348; and, 5,109,324.

In some prior art systems, such as that disclosed by U.S. Pat. No. 5,161,881, a lamp holder is formed by a base to which the lamp is mounted, the base then being joined to a cap. While the cap may be adapted for securement to a structure, it is the base which has a wireway formed therein and not the cap. Thus, when the lamp holder is removed from the cap the power cord is free and unsupported. Further, nowhere is there any provision for receiving the "split end" of the power cord in either the base or the cap.

In other systems, such as that disclosed by U.S. Pat. No. 5,199,781, an electric candle holder is provided wherein a bracket is provided for maintaining the electric candle in position on a window sill. However, this prior art system does not address the problem of wiring a plurality of electric candles which are secured to a building structure.

In still other prior art systems, such as that disclosed in U.S. Pat. No. 5,329,437, a plurality of electric candle devices may be connected in parallel to electrical wiring. However, the lighting devices are individually permanently installed at each location with a retractable assembly, as opposed to being releasably coupled thereto. Further, the disclosed system is intended to be installed on the interior of a building structure and does not provide any bracket members having wireways formed therein.

SUMMARY OF THE INVENTION

An electric candle light for releasable securement to a building structure is provided. The electric candle light includes a power cord having a pair of insulated conductors disposed in side-by-side relationship and a bracket structure for securement to the building structure. The bracket structure includes (1) a bracket member having opposing front and rear sides, (2) a wireway formed in the bracket member, and (3) means for maintaining said power cord within the wireway. The wireway includes a wire trough open to a top portion of the bracket member and extending across a central portion thereof. Further, the electric candle light includes a lamp holder adapted for slidable engagement with the bracket member. The lamp holder includes a base and an electric candle having a pair of wire leads secured to the base. Each of the pair of wire leads has an insulation piercing terminal secured thereto. The base has an open channel disposed adjacent a rear end thereof and dimensioned for slidable engagement with the bracket member. The base includes means for releasably lockingly engaging the bracket member and a pair of parallel recesses formed within the open channel for receiving the insulation piercing terminals respectively therein and maintaining the insulation piercing terminals in aligned relationship with a portion of the power cord disposed in the wire trough. Thus, the insulation piercing terminals respectively electrically connect to the pair of insulated conductors of the power cord responsive to locking engagement between the base and the bracket member.

DESCRIPTION OF THE PREFERRED EMBODIMENTS

Figure 1:
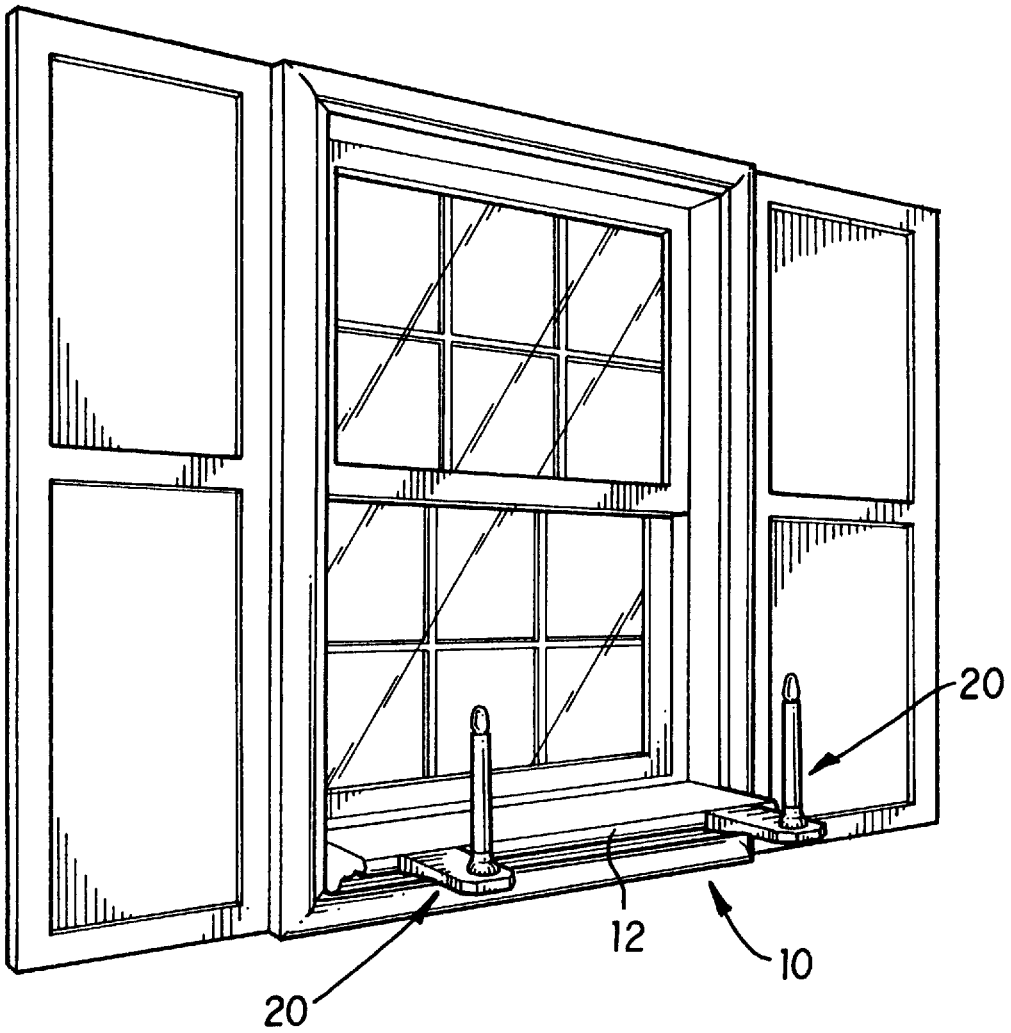
FIG. 1 is a perspective view of the electric candle light system of the present invention.

Referring now to FIGS. 1–7, there is shown electric candle light system 10 for releasable securement to a building structure to provide a decorative lighting display. As will be seen in following paragraphs, electric candle light system 10 is specifically directed to the concept of providing an aesthetically pleasing and ornamental lighting system having the capability for rapid and convenient installation. While one or more lamp holders 20 and power cord 100 may be installed for use during holiday seasons, and then subsequently removed, system 10 includes one or more bracket structures which are affixed to the building and may remain thereon throughout the year. The bracket structure includes at least one bracket member 70 which remains secured to the building structure. Bracket member 70 is formed of a transparent plastic material such that it is unobtrusive and does not detract from the building's appearance. Upon approach of another holiday season, the power cord 100 may then be threaded through the wireways 80 of the bracket members 70 and the one or more lamp holders 20 slidingly coupled to a respective bracket member 70. The system is modular, so that any of the plurality of lamp holders 20 may be secured to any one of a plurality of bracket members 70.

Figure 4:
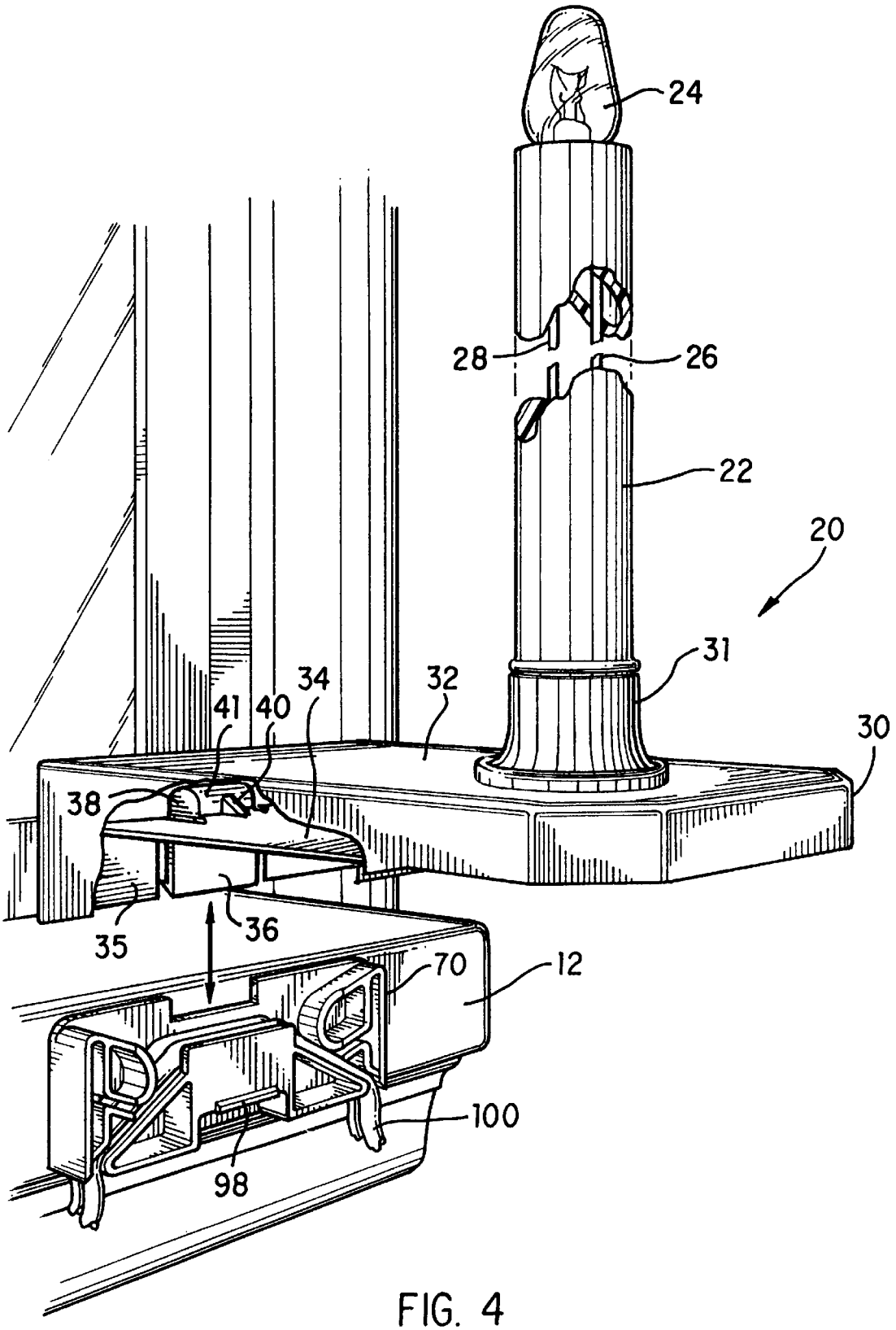
FIG. 4 is an exploded view, partially cut away, of the present invention.

Referring now to FIGS. 1 and 4, there is shown, electric candle light system 10 which includes one or more lamp holders 20 releasably secured to the building structure 12. In particular, it is customary to install electric candle-type lights to the window sill portion of a building structure, however, the bracket members 70 may be mounted to any structurally suitable portion of a building. While most conventional electric candle lights are installed on the interior of a building so as to be visible through the window panes, electric candle light system 10 is particularly adapted for installation on the exterior of the building, but still may be installed on the building's interior if the user desires. Each lamp holder 20 includes an electric candle stick 22 secured to a base 30. The candle stick 22 is a tubular structure having a coloring and texture to imitate that of a wax candle. The distal end of the tubular structure is fitted with a socket for receiving a lamp 24 therein. The socket includes appropriate gaskets or is structured so as to be weatherproof. As such weatherproof sockets are conventional in the art, the socket structure will not be further described herein, as the lamp socket forms no part of the present invention disclosed herein.

Figure 7:
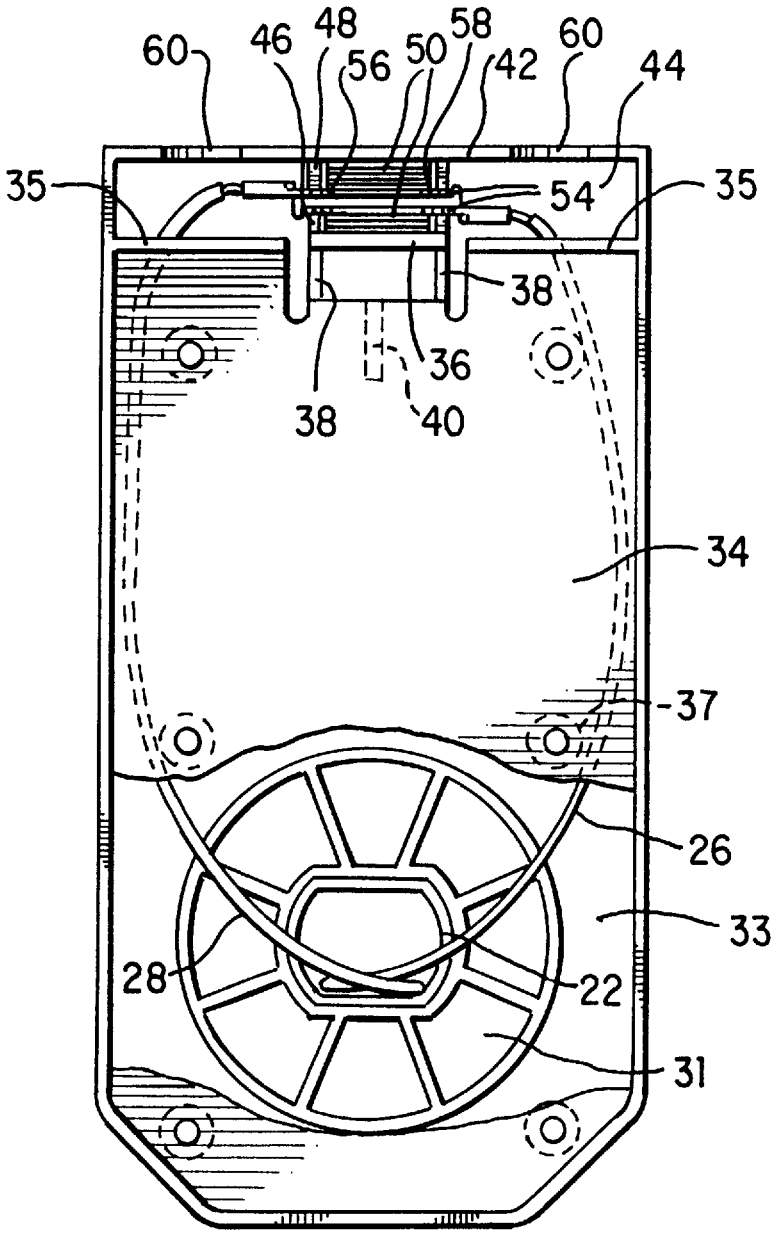

From the lamp socket, not shown, a pair of leads 26 and 28 extend through the bore of candle stick 22 into the base 30. The base 30 is provided with a top wall 32 which may incorporate a sleeve-like structure 31 into which the tubular electric candle stick is received. Candle stick 22 is secured within sleeve 31 by conventional means which may include ultrasonic or adhesive bonding. With further reference to FIG. 7, the leads 26, 28 extend through a cavity 33 defined between the top wall 32 and a bottom wall 34 that is maintained in spaced parallel relationship by a plurality of studs 37 that provide the coupling therebetween. Each of the leads 26, 28 has a terminal 50 secured to the distal end thereof, each terminal 50 being disposed in one of a pair of parallel recesses 46, 48. The recesses 46, 48 are disposed within an open channel 44 formed between the rear wall 42 of base 30 and a forward channel wall portion 35 integrally formed with the bottom wall 34 and extending downwardly therefrom. The open channel 44 is dimensioned to slidingly receive a respective bracket member 70 therein.

Figure 2:
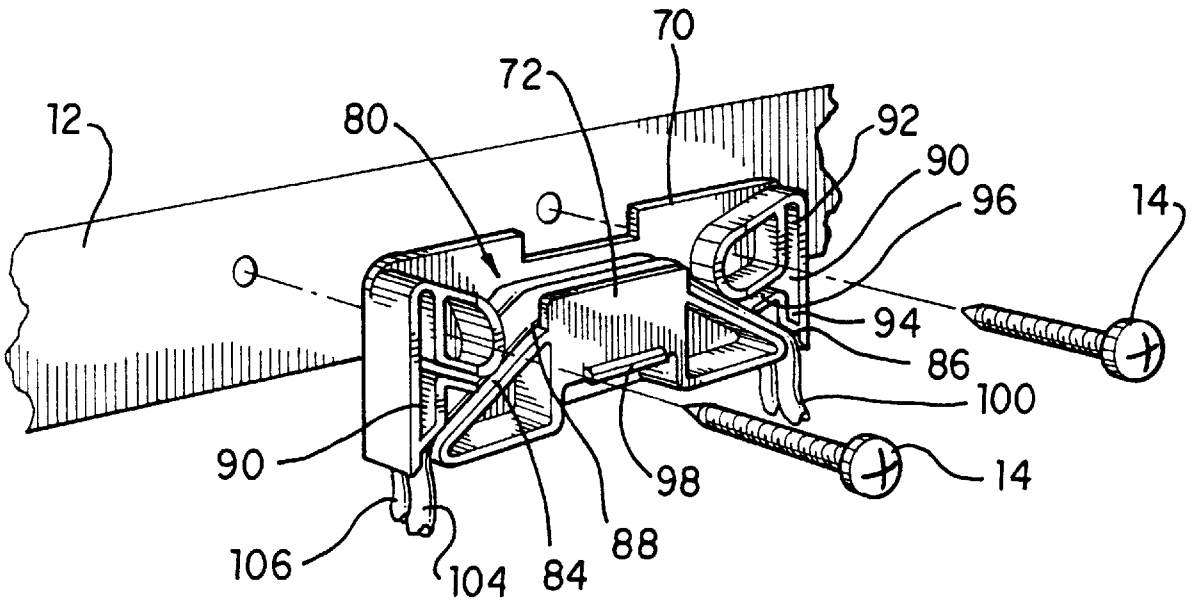
FIG. 2 is a perspective view of the bracket member of the present invention.
Figure 3:
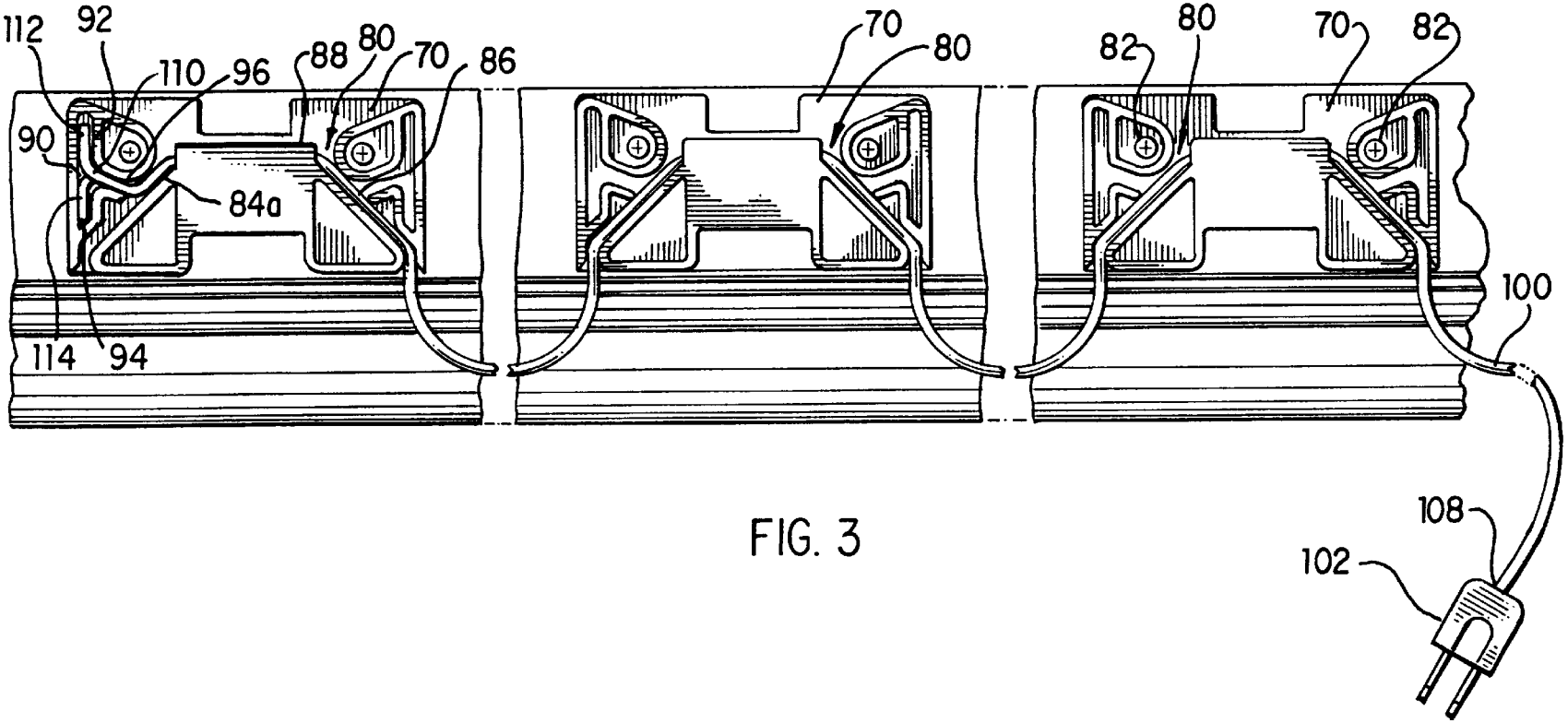
FIG. 3 is an elevation view depicting the threading of the power cord through the wireways formed in the brackets of the present invention.
Figure 5:
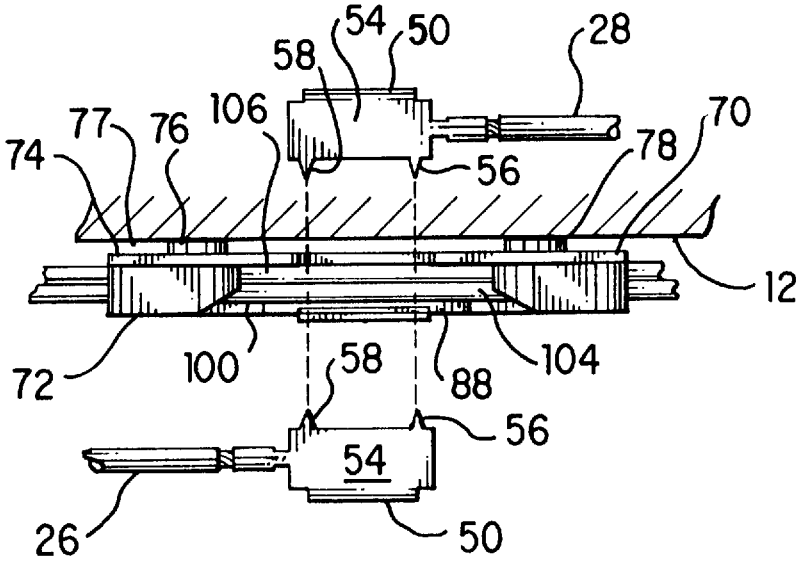
FIG. 5 is a top plan view schematically representing the electrical connection between the lead terminals and power cord of the present invention.

Referring additionally to FIG. 2, the bracket member 70 is shown for mounting to the building structure 12 by means of a pair of fasteners 14 that pass through respective mounting apertures 82, shown in FIG. 3. Bracket member 70 may be formed of a transparent plastic material composition capable of withstanding prolonged exposure to ultraviolet light. Bracket member 70 cooperates with a respective base 30 to provide a releasable coupling of the lamp holder 20 to the building structure, while simultaneously cooperating in electrical coupling between the lamp holder 20 and a power cord 100. To provide for the releasable coupling of the lamp holder 20 to the building structure, bracket member 70 includes a pair of projections 76, 78, shown in FIGS. 5 and 6, extending from the rear side 74 thereof. As shown in FIG. 5, the projections 76, 78 provide a space 77 between the rear side 74 and the surface of the building structure 12 into which the rear wall 42 of base 30 will be received when the lamp holder 20 is slidingly coupled to the bracket member 70. The rear wall 42 of base 30 is provided with a pair of slotted openings 60 into which the projections 76, 78 are respectively received, thereby allowing the rear wall 42 to slide into the space 77 between the building structure and the rear side 74 of bracket member 70.

The forward channel wall portion 35 of base 30 is spaced from the rear wall 42 by a distance substantially equal to the thickness of the bracket member 70, thereby permitting the bracket member 70 to be slidingly received within the open channel 44. The base 30 is provided with the means by which the lamp holder 20 may be releasably lockingly secured to the bracket member 70. Base 30 includes a tab member 36 having a hook-like distal end for engaging a lip 98 which extends from the front side 72 of bracket member 70.

Tab member 36 may be integrally formed with the structure of base 30. In one working embodiment, the tab member 36 is integrally formed with the bottom wall 34, with an arcuate fulcrum region 41 having a substantially U-shaped cross-sectional contour. The fulcrum region 41 is reinforced by side reinforcement portions 38 and a rear brace member 40 extending from the planar bottom wall surface to the portion of arcuate fulcrum region 41 that extends from the bottom wall surface in a direction opposite to that of the remainder of the tab. By that arrangement, the strength and spring-like action of the cantilever tab 36 is greatly improved over that which would be obtained if the tab were formed or bent transversely in the plane defined by bottom wall 34.

As shown in FIGS. 2 and 3, bracket member 70 includes a wireway 80 through which the power cord 100 is passed. Wireway 80 is formed by a pair of exit grooves 84 and 86 formed in the front side 72 of bracket member 70 and extending from respective opposing ends thereof to a central portion of the bracket. A wire trough 88 extends across the central portion of bracket member 70 to receive each of the insulated conductors 104, 106 of power cord 100 in side-by-side relationship. Power cord 100 is a two-conductor cable having a pair of insulated conductors 104, 106 formed together in side-by-side relationship, the insulating material thereof being weatherproof and self-sealing.

Each of the exit grooves 84, 86 is dimensioned to frictionally engage the power cord for retaining the power cord within the wireway. The distal end 110 of power cord 100 is longitudinally split to separate the two insulated conductors 104, 106 from one another. Each bracket member 70 includes at least one T-shaped groove 90 formed in the front side thereof and intersecting one of the exit grooves 84, 86. Preferably, the bracket member 70 includes a pair of T-shaped grooves 90, one intersecting each of the exit grooves 84 and 86. The T-shaped groove 90 is formed by a pair of opposing transverse channels 92 and 94 extending from one end of a central channel 96 which interconnects the first and second transverse channels 92, 94 with a respective exit groove 84, 86. The walls of bracket member 70 that form the endmost portion of central channel 96, adjacent the respective exit channel 84, 86, extends sufficiently into the exit channel to provide at least a portion of the frictional engagement between the power cord 100 and the exit channel.

Thus, when installing system 10, the first split end 112 is positioned within the transverse channel 92 and the second split end 114 is positioned within the transverse channel 94, with the adjacent portion of the distal end 110 of power cord 100 being passed through the central channel 96 of the T-shaped groove 90 of an endmost bracket member 70. The power cord 100 is threaded through an upper portion of the adjacent exit groove 84*a*, across the wire trough 88 and through the other exit groove 86. A remaining portion of the power cord 100 is subsequently threaded through the respective wireways of other bracket members 70 disposed at other locations on the building, such as the window sills of other windows. For each of the other bracket members 70 the power cord 100 passes through both exit grooves 84, 86 and across the wire trough 88. The end 108 of power cord 100 which remains after the power cord has been threaded through all of the remaining bracket members 70 is provided with a standard plug 102 for connection with a conventional outlet. Plug 102 may be of the type having a protective fuse incorporated therein. Typically, a single power cord 100 may be utilized to feed power to twelve lamp holders 20, with the power cord 100 passing through the wireway 80 of twelve bracket members 70, the power cord providing a power bus through which each of the lamp holders 20 are connected in parallel.

Figure 6:
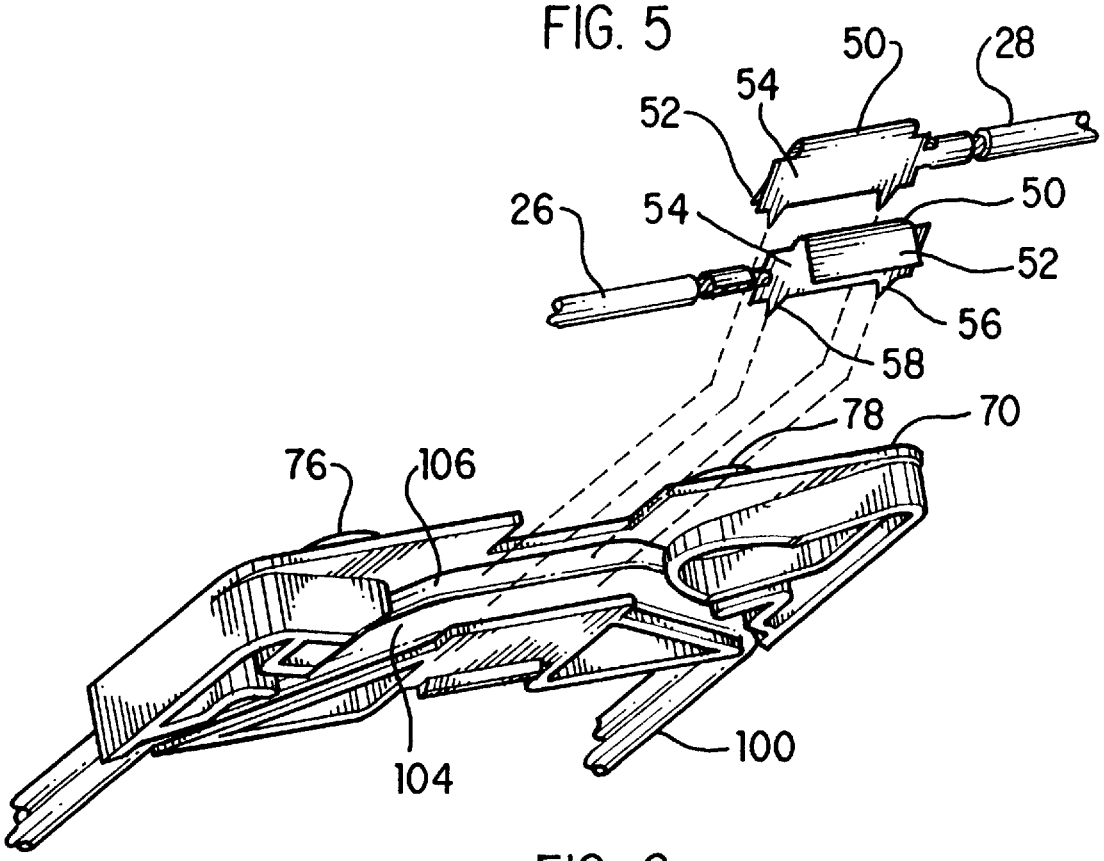
FIG. 6 is a perspective view of the bracket of the present invention schematically illustrating the connection of the lamp terminals thereto; and, FIG. 7 is a bottom plan view, partially cut away, of the base portion of the lamp holder of the present invention.

To facilitate the rapid electrical connection of each lamp holder 20 with the power cord 100, the terminals 50 coupled to the leads 26 and 28 are of the insulation piercing type. As shown in FIGS. 5 and 6, each of the terminals 50 are provided with a pair of piercing projections 56 and 58. While a terminal having a single piercing projection could be utilized, the redundancy of a pair of electrical contacting members provides higher reliability and therefore a higher quality product. Each of the terminals 50 is formed in a substantially U-shaped cross-sectional contour to form a pair of legs 52 and 54. Leg 54 of each terminal 50 is provided with the piercing projections 56 and 58, both of which pass through the insulation to make electrical contact with a respective insulated conductor 104, 106.

As shown in FIG. 7, each of the U-shaped terminals 50 is disposed within a respective recess 46, 48, the recesses being in spaced parallel relationship. The respective legs 52, 54 of each terminal frictionally engage the opposing walls of the respective recess 46, 48 in order to secure the terminal 50 therein. The two terminals 50 are positioned within the respective recesses such that their legs 54 are disposed on adjacent sides of the recesses 46, 48. The respective legs 54 of each of the terminals 50 being spaced a predetermined distance thereby so that the respective piercing projections of each of the terminals are substantially centered over a respective one of the insulated conductors 104, 106 of power cord 100. Thus, when the lamp holder 20 is slidably engaged with a respective bracket member 70 the piercing projections 56, 58 of each of the terminals 50 are displaced through the insulation portion of a respective one of the insulated conductors 104, 106 in the portion of the power cord 100 extending across the wire trough 88. When the lamp holder 20 has been sufficiently engaged with the bracket member 70 such that the tab 36 lockingly engages the lip 98, the piercing projections 56, 58 have sufficiently penetrated the insulated conductors 104, 106 to make electrical contact therewith. As the bracket member 70 is disposed within the open channel 44 of base 30, such provides a shield to protect the electrical connection from the elements.

Removal of any individual lamp holder 20 from its coupling with a respective bracket member 70 is easily accomplished. The user simply displaces the distal end of the tab member 36 from its engagement with lip 98 and slidingly upwardly displaces the base 30. The displacement of the tab member 36 out of engagement with lip 98 provides the mechanical release for unlocking the lamp holder 20 from its engagement with the bracket member 70, and the upward displacement of the base relative to the bracket member 70 disengages the lamp holder from the bracket member and simultaneously breaks the electrical connection between the leads 26, 28 and the power cord 100. As the insulation of power cord 100 is formed of a self-sealing and weatherproof material, such is not damaged by exposure to the elements while the lamp holder 20 is removed. However, where the lamp holder will not be reinstalled for a long period of time, it is advisable that the power cord 100 be removed from its threaded engagement with each of the bracket members 70 and subsequently reinstalled when the lamp holders 20 are again to be utilized. The bracket members 70 remain secured to the building structure for subsequent use and are formed of a transparent plastic material so they will not detract from the aesthetics of the structure to which they are affixed.

It can therefore be seen that the electric candle light system 10 permits one or more lamp holders 20 to be releasably secured to the exterior or interior of a building structure utilizing a respective number of bracket members 70. Each lamp holder 20 is electrically connected to a power cord 100 simultaneous with its mechanical coupling to a respective bracket member 70, as each bracket member 70 includes a wireway 80 through which the power cord 100 passes and is maintained. Each bracket member 70 includes a T-shaped channel 90 for receiving a split end portion of the power cord therein, wherein each split end 112, 114 of power cord 10 is disposed within a separate cavity formed by a respective transverse channel 92, 94, providing electrical isolation thereof. Each lamp holder 20 includes a base 30 having a tab member 36 integrally formed with a bottom wall 34 thereof. The tab member 36 provides a means for releasably locking the lamp holder 20 to a respective bracket member 70.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. An electric candle light for releasable securement to a building structure, comprising:

a power cord having a pair of insulated conductors disposed in side by side relationship;

bracket means for securement to the building structure, said bracket means including (1) a bracket member having a pair of opposing sides, (2) a wireway formed in said bracket member, and (3) means for retaining said power cord within said wireway, said wireway including a wire trough open to a top portion of said bracket member and extending across a central portion thereof, said wireway including a pair of exit grooves formed in a first of said pair of opposing sides of said bracket member and extending from respective opposing ends of said bracket member to a respective end of said wire trough and at least one substantially T-shaped groove formed in said first side of said bracket member and intersecting one of said pair of exit grooves for receiving a split end portion of said power cord therein; and, a lamp holder adapted for slidable engagement with said bracket member, said lamp holder including a base and an electric candle having a pair of wire leads secured to said base, each of said pair of wire leads having an insulation piercing terminal secured thereto, said base having an open channel disposed adjacent an end wall thereof and dimensioned for slidable engagement with said bracket member, said base including (a) means for releasably lockingly engaging said bracket member, and (b) a pair of parallel recesses formed within said open channel for receiving said insulation piercing terminals respectively therein and maintaining said insulation piercing terminals in aligned relationship with a portion of said power cord disposed in said wire trough, whereby said insulation piercing terminals respectively electrically connect to said pair of insulated conductors of said power cord responsive to locking engagement between said base and said bracket member.

2. The electric candle light as recited in claim 1 where said bracket member includes a pair of projections extending from a second of said pair of opposing sides of said bracket member for forming a space for receiving a portion of said end wall of said base.

3. The electric candle light as recited in claim 1 where each of said insulation piercing terminals is formed in a substantially U-shaped cross-sectional contour with a pair of spaced apart legs for frictionally engaging opposing walls of a respective one of said pair of parallel recesses.

4. The electric candle light as recited in claim 3 where each of said insulation piercing terminals has a pair of piercing projections extending from one of said pair of legs thereof.

5. The electric candle light as recited in claim 4 where said insulation piercing terminals are disposed within said pair of parallel recesses with said leg having said piercing projections of one said terminal disposed adjacent said leg having said piercing projections of said other terminal.

6. The electric candle light as recited in claim 1 where said means for releasably lockingly engaging said bracket member includes a tab member integrally formed in one wall of said open channel.

7. The electric candle light as recited in claim 1 where each of said pair of exit grooves is dimensioned to frictionally engage said power cord for retaining said power cord within said wireway.

8. An electric candle light for releasable securement to a building structure, comprising:

a power cord having a pair of insulated conductors disposed in side by side relationship;

a bracket member having a pair of opposing sides secured to the building structure, said bracket member having a wireway formed by (1) a pair of exit grooves formed in a first of said pair of opposing sides and extending from respective opposing ends of said bracket member to a central portion thereof, each of said pair of exit grooves being dimensioned to frictionally engage said power cord for retaining said power cord within said wireway, and (2) a wire trough open to an upper portion of said bracket member and extending across said central portion between said pair of exit grooves, said bracket member including at least one substantially T-shaped groove formed in said first side and intersecting one of said pair of exit grooves for receiving a split end portion of said power cord therein;

an electric candle having a pair of wire leads extending therefrom;

a pair of insulation piercing terminals respectively coupled to said pair of wire leads;

a base having an open channel disposed adjacent an end wall thereof and dimensioned for slidable engagement with said bracket member, said base having an upper surface adapted for coupling with said electric candle, said base including means for releasably lockingly engaging said bracket member and being adapted for securing said pair of insulation piercing terminals within said open channel in aligned relationship with a portion of said power cord disposed in said wire trough, whereby said insulation piercing terminals respectively electrically connect to said pair of insulated conductors of said power cord responsive to locking engagement between said base and said bracket member.

9. The electric candle light as recited in claim 8 where said bracket member includes a pair of projections extending from a second of said pair of opposing sides of said bracket member for forming a space for receiving a portion of said end wall of said base.

10. The electric candle light as recited in claim 8 where said base has a pair of parallel recesses formed in said open channel for respectively receiving said pair of insulation piercing terminals therein.

11. The electric candle light as recited in claim 10 where each of said pair of insulation piercing terminals is formed in a substantially U-shaped cross-sectional contour with a pair of spaced apart legs for frictionally engaging opposing walls of a respective one of said pair of parallel recesses.

12. The electric candle light as recited in claim 11 where each of said insulation piercing terminals has a pair of piercing projections extending from one of said pair of legs thereof.

13. The electric candle light as recited in claim 12 where said insulation piercing terminals are disposed within said pair of parallel recesses with said leg having said piercing projections of one said terminal disposed adjacent said leg having said piercing projections of said other terminal.

14. The electric candle light as recited in claim 8 where said means for releasably lockingly engaging said bracket member includes a tab member integrally formed in one wall of said open channel.

15. The electric candle light as recited in claim 14 where said tab member is formed integrally with a lower wall of said base.

16. An electric candle light system for releasable securement to a building structure, comprising:

a power cord having a pair of insulated conductors formed together in side by side relationship, said power cord having a plug coupled to said pair of insulated conductors on one end thereof, said pair of insulated conductors being separated on an opposing end thereof to define a split apart end of said power cord;

a plurality of bracket members spaced one from another and secured to the building structure, each of said plurality of bracket members having opposing first and second sides and a wireway formed by (1) a pair of exit grooves formed in said first side and extending from respective opposing ends of said bracket member to a central portion thereof, and (2) a wire trough open to an upper portion of said bracket member and extending across said central portion between said pair of exit grooves, said power cord being threaded through said wireway of each of said plurality of bracket members, each of said bracket member including at least one substantially T-shaped groove formed in said first side and intersecting one of said pair of exit grooves, an endmost one of said plurality of bracket members receiving said split apart end of said power cord within said T-shaped groove thereof; and, a plurality of lamp holders respectively slidably engaged with said plurality of bracket members, each of said lamp holders including a base and an electric candle having a pair of wire leads secured to said base, each of said pair of wire leads having an insulation piercing terminal secured thereto, said base having an open channel disposed adjacent an end wall thereof and dimensioned for slidable engagement with a respective one of said bracket members, said base including means for releasably lockingly engaging a respective one of said bracket members and being adapted for securing said pair of insulation piercing terminals within said open channel in aligned relationship with a portion of said power cord disposed in said wire trough of a respective one of said bracket members, whereby said insulation piercing terminals respectively electrically connect to said pair of insulated conductors of said power cord responsive to locking engagement between said base and a respective one of said bracket members.

17. The electric candle light as recited in claim 16 where each said base has a pair of parallel recesses formed in said open channel for receiving a respective pair of insulation piercing terminals therein, each of said pair of insulation piercing terminals being formed in a substantially U-shaped cross-sectional contour with a pair of spaced apart legs for frictionally engaging opposing walls of a respective one of said pair of parallel recesses.

* * * * *